US008677922B2

(12) United States Patent
Cooney

(10) Patent No.: US 8,677,922 B2
(45) Date of Patent: Mar. 25, 2014

(54) BOAT WITH A LATCH ASSEMBLY

(75) Inventor: John R. Cooney, Midland, MI (US)

(73) Assignee: Avalon Pontoons, Alma, MI (US)

( * ) Notice: Subject to any disclaimer, the term of this patent is extended or adjusted under 35 U.S.C. 154(b) by 277 days.

(21) Appl. No.: 13/194,662

(22) Filed: Jul. 29, 2011

(65) Prior Publication Data

US 2013/0025524 A1 Jan. 31, 2013

(51) Int. Cl.
*B63B 17/00* (2006.01)

(52) U.S. Cl.
USPC ..... 114/343

(58) Field of Classification Search
USPC ..... 114/343, 364, 201 R, 202; 292/1, 137, 292/138, 145, 146, 150, 182–189, 302, 292/DIG. 29, DIG. 63
See application file for complete search history.

(56) References Cited

U.S. PATENT DOCUMENTS 1,658,762 A * 2/1928 Dickerson ..... 292/5
6,443,088 B1 * 9/2002 Putman et al. ..... 114/343
6,854,414 B1 * 2/2005 Huntley ..... 114/364

* cited by examiner

*Primary Examiner* — Stephen Avila
*Assistant Examiner* — Anthony Wiest
(74) *Attorney, Agent, or Firm* — Robert L. Stearns; Dickinson Wright, PLLC

(57) ABSTRACT

A boat including at least two wall segments extending generally upwardly from a deck to define an interior space. The wall segments are spaced from one another to define a passage for allowing passengers to enter and exit the interior space. A gate is secured to one of the wall segments for controlling access to the interior space. A latch assembly including base and sliding members is coupled to an end of one of the wall segments. The sliding member is movable between a latched position for trapping a portion of the gate and an unlatched position for releasing the gate. At least one glide plate of a low-friction material is disposed between the base and sliding members. Additionally, when the sliding member is in the unlatched position, the base member presents a strike surface for receiving contact from the gate to protect the wall segment.

19 Claims, 8 Drawing Sheets

BOAT WITH A LATCH ASSEMBLY

BACKGROUND OF THE INVENTION

1. Field of the Invention

The subject invention is related to a boats. More specifically, the subject invention is related to boats having a gate and a latch assembly.

2. Description of the Related Art

Recreational boats are continuously improving and becoming increasingly luxurious. Many boats, such as pontoon boats, include a gate extending between two wall segments and rotatable between open and closed positions for controlling access into and out of the interior space of the boat. The gate is releasably secured in the closed position with a latch assembly.

One type of latch assembly employed in many pontoon boats includes a pivoting member which is rotatably secured to one of the wall segments and presents a pair of outwardly extending legs which are spaced from one another by a width that is slightly greater than the width of the gate. When the gate is moved to the closed position, a user can rotate the two-legged latch downwardly into a latched position with the gate trapped between the legs to lock the gate in the closed position relative to the adjacent wall segment. The user may open the gate by pivoting the latch upwardly. While effective at latching the gate in the closed position and being simply constructed, such two-legged latch mechanisms have their drawbacks. Such latches are prone to damage since excessive opening or closing pressure applied to the gate is born by one or the other legs, and they can bend under excessive load. The spacing of the legs on either side of the gate when in the closed position and the metal-to-metal contact if the latch is made of aluminum makes such latches prone to noise, as the gate may have a tendency to rattle back and forth against the legs during operation of the boat. Making such two-legged latches out of plastics material is an option to alleviate the noise issues and reduce the opportunity for bending, but such plastics materials also have their limits and are prone to breakage and possible deterioration with prolonged exposure to the elements. In addition to their functional limitations, such two-legged latches are very utilitarian and may lack the appearance desired for higher end boat applications.

SUMMARY OF THE INVENTION

A boat is provided including a deck and a plurality of wall segments extending upwardly from the deck to at least partially define an interior space for accommodating passengers. At least two of the wall segments have ends that are spaced from one another to present a gap or passage through which passengers may enter and exit the interior space. A gate is hingedly connected to the end of one of the wall segments for selectively opening and closing the passage. A latch assembly is further provided for latching the gate to the other wall segment. The latch assembly includes a stationary base member secured to either the wall segment or the gate and a sliding member, which is slidably coupled to the base member. The sliding member is movable between a latched position for latching the gate in the closed position and an unlatched position for releasing the gate. Specifically, the latch assembly is configured to trap a portion of the gate between the base and sliding members when the sliding member is in the latched position.

According to a further aspect of the invention, the latch assembly includes at least one glide plate made of a low-friction material different than that of the base member and the sliding member disposed between the sliding and base members to provide a low friction contact surface between the base and sliding members. This allows the sliding member to slide smoothly and with low force between the latched and unlatched positions. The latch assembly is thus easier to use than the prior art latch assemblies and allows the base and sliding members to be made of hard, durable materials, giving the boat a more luxurious appearance.

According to a further aspect of the invention, a strike arm is disposed on the gate and the base member includes a strike surface which is exposed when the sliding member is in the unlatched position. When the gate is moved to the closed position, the strike arm contacts the strike surface of the latch assembly and there is no contact between the gate and the wall segment. In other words, the base member protects the wall segment from dents, paint chips or other damage if someone slams the gate. The base member is preferably made of a metal, such as stainless steel, and therefore, the strike surface is able to absorb the contact with the gate with little to no damage.

BRIEF DESCRIPTION OF THE DRAWINGS

These and other features and advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
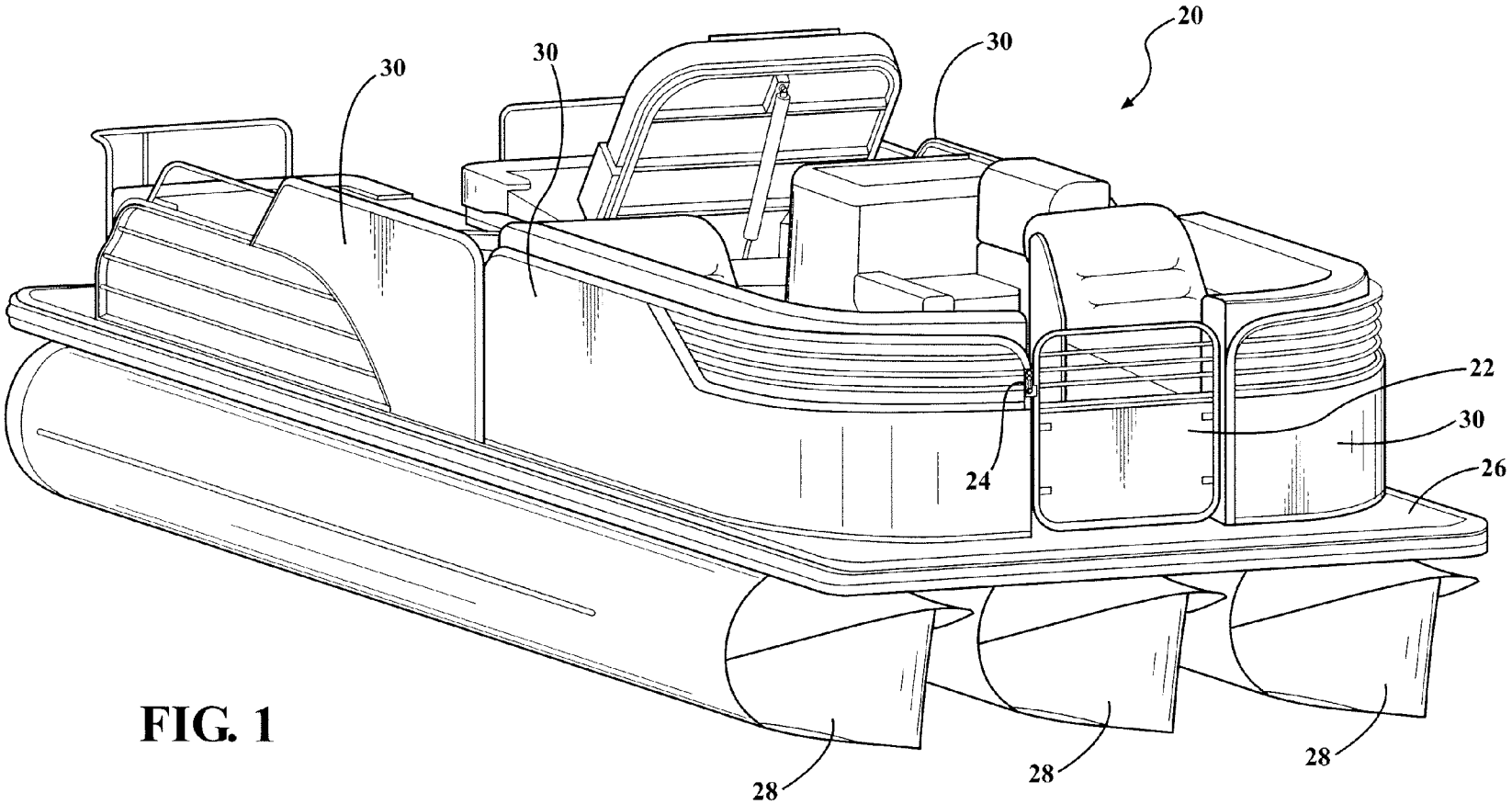
FIG. 1 is a perspective and elevation view of an exemplary pontoon boat with a gate in a closed position.
Figure 2:
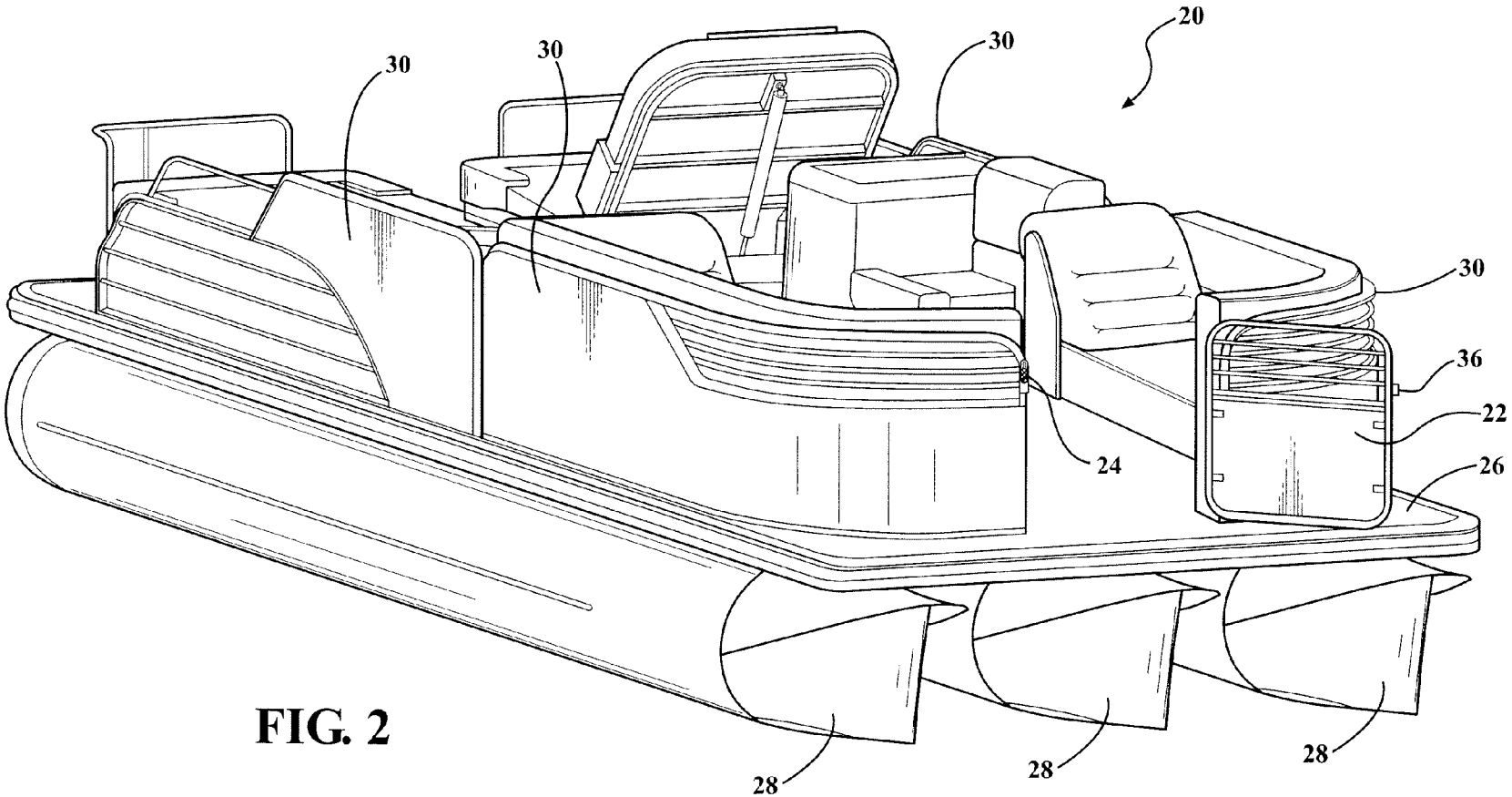
FIG. 2 is another perspective and elevation view of the exemplary pontoon boat with the gate in an open position.

Referring to the Figures, wherein like numerals indicate corresponding parts throughout the several views, an exemplary pontoon boat 20 with a gate 22 and a latch assembly 24 is generally shown in FIGS. 1 and 2. It should be appreciated that the boat does not have to be a pontoon boat 20 as shown in the exemplary embodiment, but instead could be any other type of boat including, for example, a ski boat, a yacht or a sail boat. The exemplary pontoon boat 20 includes a deck 26 supported by three pontoons 28 extending in spaced and parallel relationship with one another. When placed in a body of water, the pontoons 28 floatably support the deck 26 and the rest of the pontoon boat 20. It should be appreciated that the pontoon boat 20 could include any desirable number of pontoons 28 to floatably support the deck 26.

The pontoon boat 20 includes a plurality of wall segments 30 disposed on the deck 26 and extending generally upwardly therefrom to define an interior space of the pontoon boat 20 for accommodating passengers. Each of the wall segments 30 extends to free top edge rather than to a roof. As shown in FIGS. 1 and 2, the wall segments 30 are spaced from one another in a predetermined location at the front of the pontoon boat 20 to present a gap or passage for allowing passengers to enter and exit the interior space. A gate 22 is disposed at the passage for selectively opening and closing the passage and hingedly coupled to one of the wall segments 30. The gate 22 is shown in a closed position in FIG. 1 and in an open position in FIG. 2. It should be appreciated that the pontoon boat 20 could include additional passages and gates 22 for allowing passengers to enter and exit the pontoon boat 20 from other locations. For example, it might be desirable to include a gate on the back or on one of the sides of the pontoon boat 20.

Figure 3:
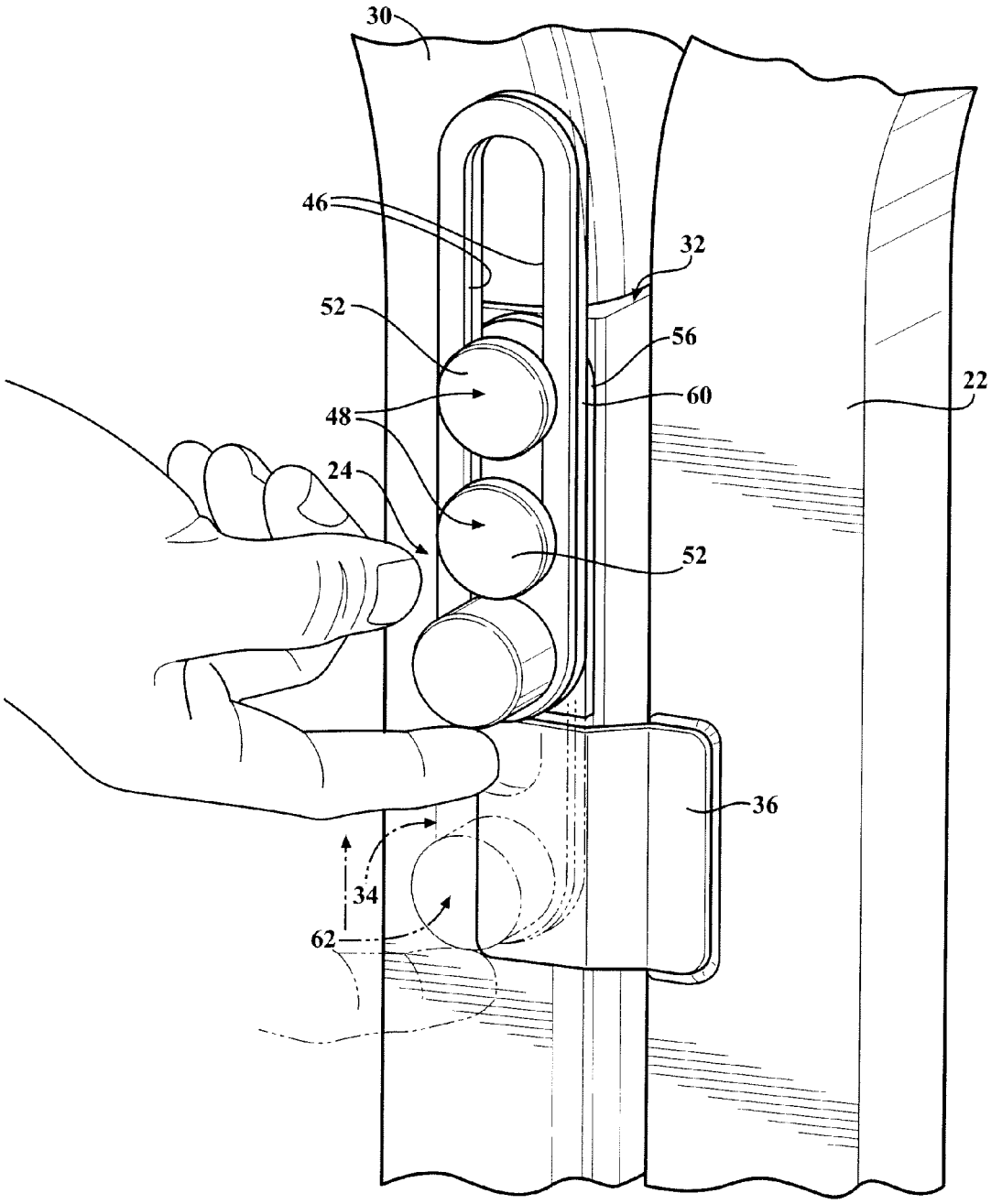
FIG. 3 is a fragmentary view of an exemplary latch assembly being held in an unlatched position and about to receive the strike plate of a gate.
Figure 4:
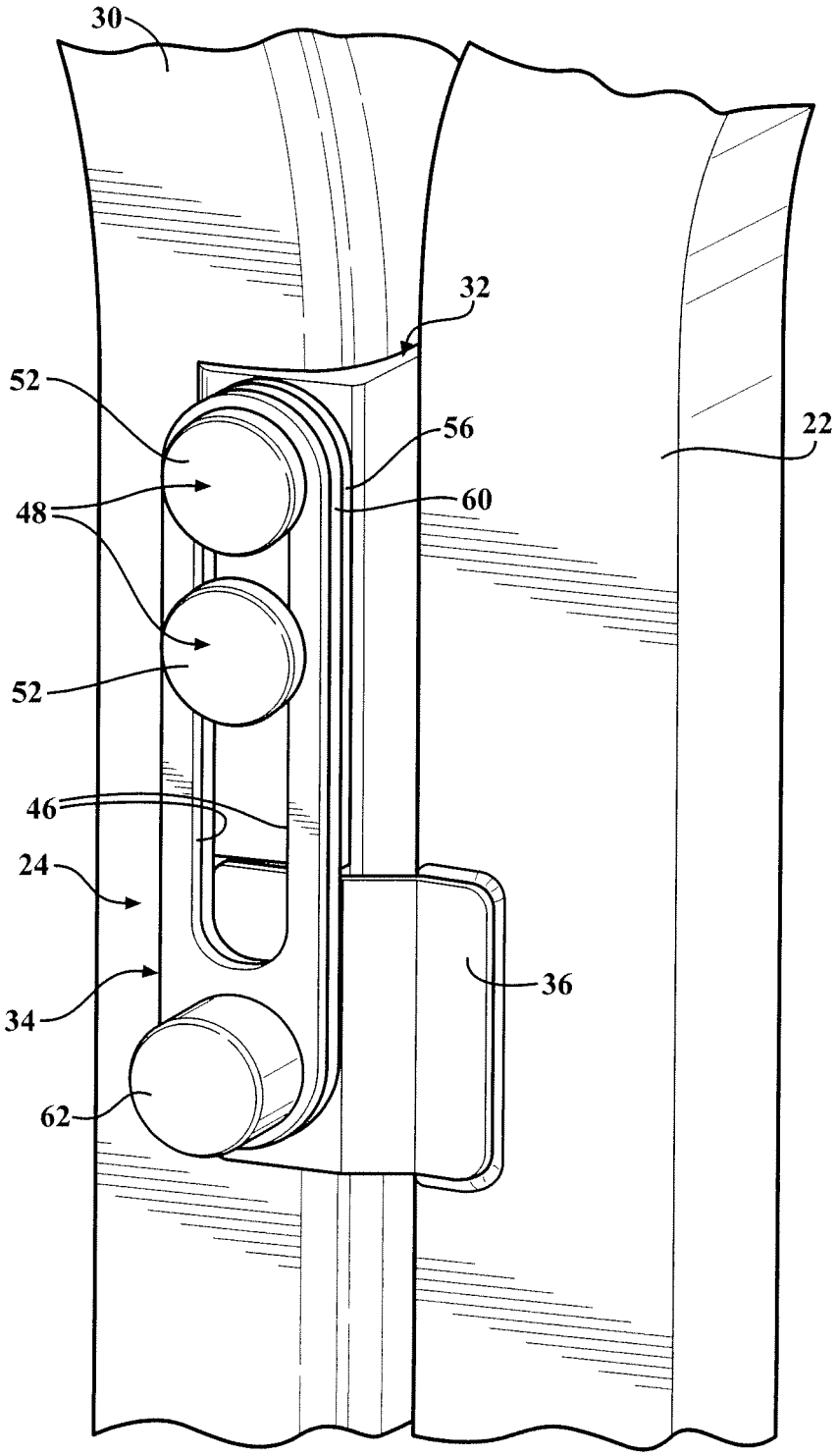
FIG. 4 is a fragmentary view of an exemplary latch assembly latching a gate in a closed position.

FIG. 3 shows a closer view of the exemplary latch assembly 24 being held in an unlatched position adjacent the gate 22. The exemplary latch assembly 24 latching the gate 22 in the closed position is shown in FIG. 4. For descriptive purposes, the wall segments 30 on either side of the passage are referred to as first and second wall segments 30. The latch assembly 24 is coupled to an end of one of the wall segments 30 for selectively latching the gate 22 in the closed position. However, it should be appreciated that the latch assembly 24 could alternately be coupled to the gate 22 rather than the wall segment 30.

Figure 5:
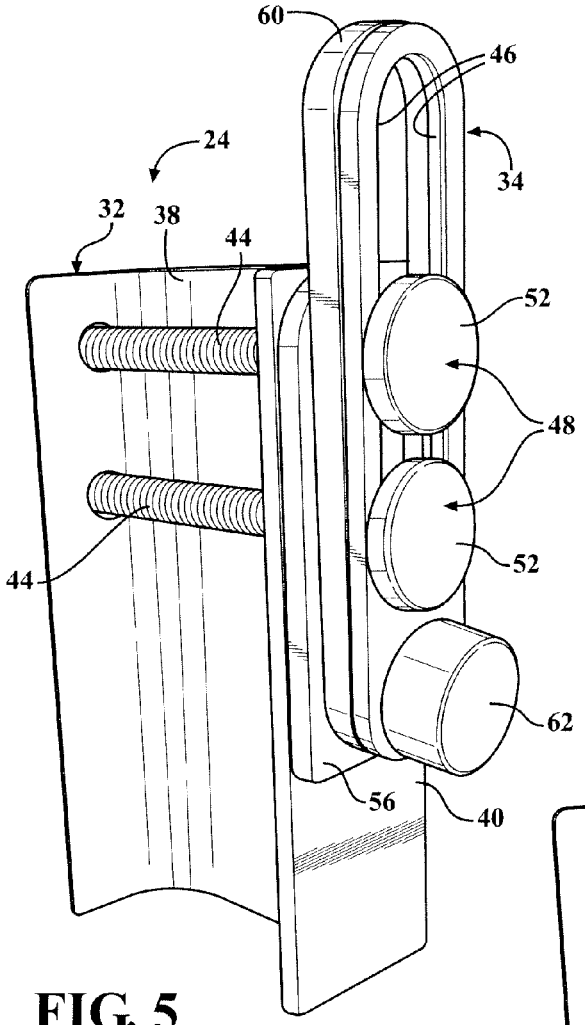
FIG. 5 is a perspective and elevation view of the exemplary latch assembly in an unlatched position.
Figure 6:
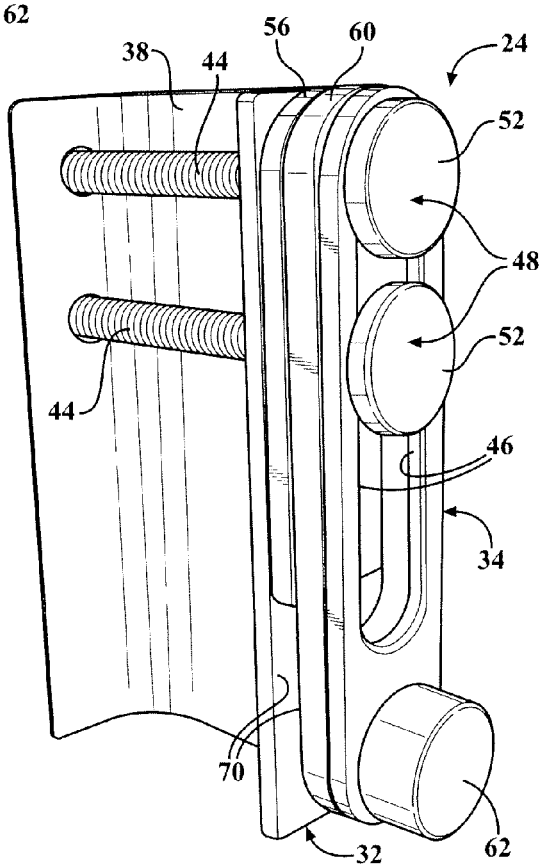
FIG. 6 is a perspective and elevation view of the exemplary latch assembly in a latched position.

The exemplary latch assembly 24 is best shown in FIGS. 5 and 6 and includes a stationary base member 32 and a sliding member 34. The base member 32 is fixed to the end of the wall segment 30, and the sliding member 34 is slidably coupled to the base member 32 for moving relative to the base member 32. Specifically, the sliding member 34 can slide in a vertical direction between a latched position (shown in FIGS. 4 and 6) and an unlatched position (shown in FIGS. 3 and 5). As shown in FIG. 3, a strike arm 36 is disposed on the gate 22 and extending outwardly therefrom. In operation, when the sliding member 34 is in the unlatched position, the gate 22 and the strike arm 36 are free to swing between the open and closed positions. As will be discussed in greater detail below, the latch assembly 24 is configured to trap the strike arm 36 between the base and sliding members 32, 34 to latch the gate 22 in the closed position when the sliding member 34 is in the latched position.

When a passenger wants to latch the gate 22 in the closed position, he or she simply raises the sliding member 34 to the unlatched position shown in FIG. 3, swings the gate 22 to the closed position shown in FIG. 4 and lowers the sliding member 34 to the latched position, thus trapping the strike arm 36 between the base and sliding members 32, 34. As will be discussed in greater detail below, there is a low friction contact surface between the base and sliding members 32, 34, which reduces the force required to raise the sliding member 34. Additionally, because of the low friction contact surface, the sliding member 34 will fall back to the latched position when released. In other words, the default position of the sliding member 34 is the latched position. To re-open the gate 22, the passenger simply raises the sliding member 34 back into the unlatched position, thus freeing the gate 22 to swing back to the open position.

The base and sliding members 32, 34 of the latch assembly 24 are preferably of stainless steel for durability, corrosion-resistance and appearance purposes. However, it should be appreciated that various metals or other materials could be employed for either or both of the base and sliding members 32, 34, including but not limited to, aluminum, steel, plastics, etc.

Figure 7:
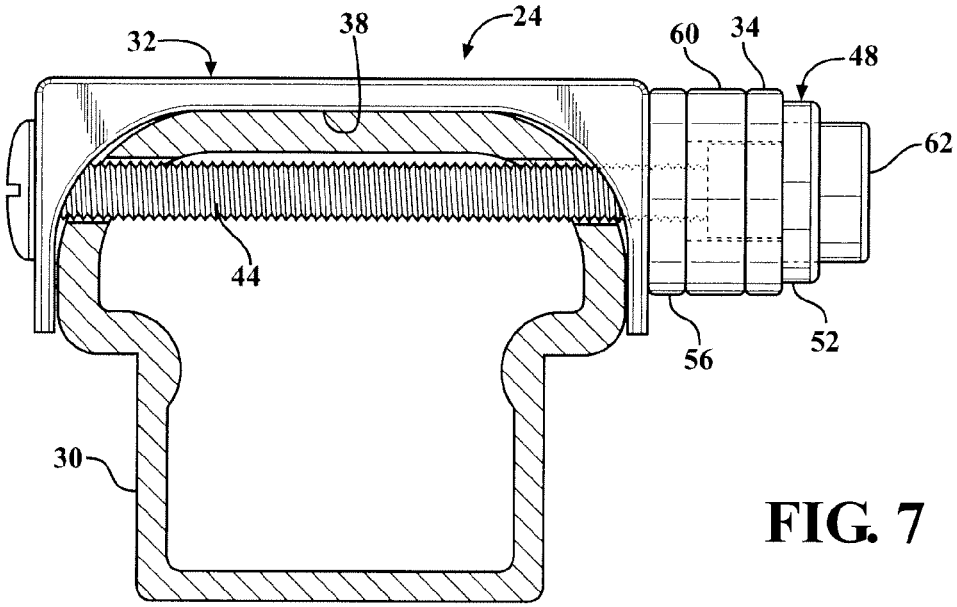
FIG. 7 is a top view of the exemplary latch assembly.
Figure 8:
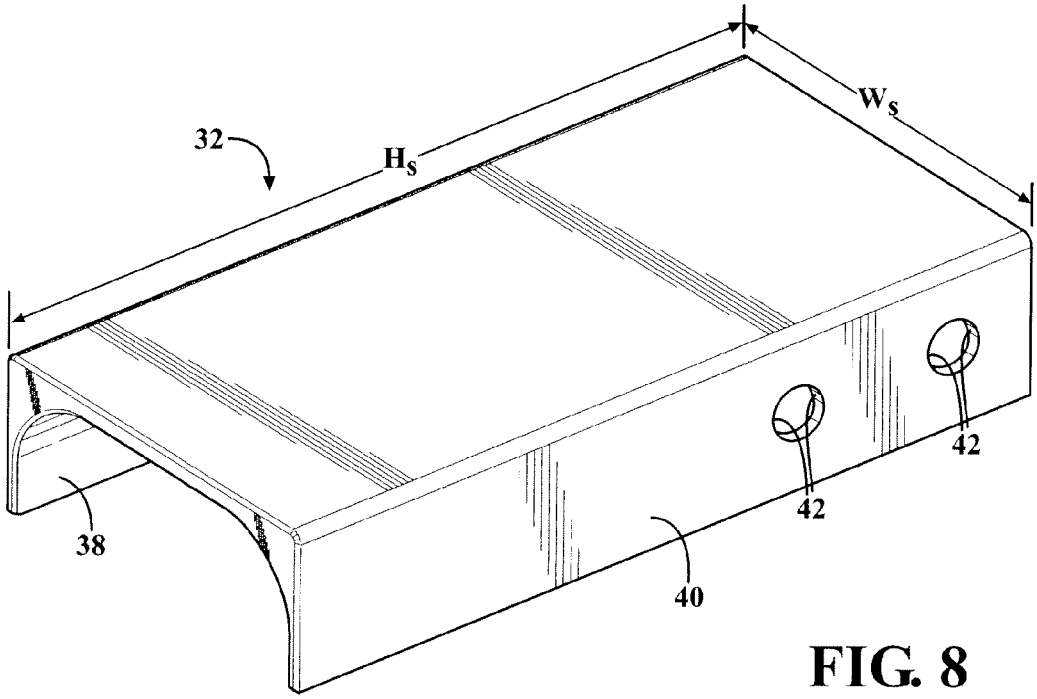
FIG. 8 is a perspective and elevation view of the base member of the exemplary latch assembly.

As shown in FIG. 8, the base member 32 has a first height $H_S$ and a first width $W_S$. The base member 32 also presents a back surface 38 (best shown in FIG. 7), which is shaped to receive the end of the second wall segment 30. For example, in the exemplary embodiment, the profile of the end of the second wall segment 30 is generally U-shaped. Therefore, the back surface 38 of the base member 32 is generally U-shaped for receiving the end of the second wall segment 30. Referring back to FIG. 5, the base member 32 also presents a side surface 40, which faces the sliding member 34. When the sliding member 34 is in the unlatched position shown in FIG. 6, a portion of the side surface 40 is exposed, which functions as a strike surface for receiving contact from the strike arm 36 on the gate 22 to protect the second wall segment 30. In other words, when the passenger swings the gate 22 to the closed position, the strike arm 36 on the gate 22 encounters the strike surface of the base member 32 rather than the second wall segment 30, thus protecting the second wall segment 30 from dents, paint chips, etc.

As shown in FIG. 8, a pair of vertically spaced base member apertures 42 extend through the side surface 40 of the base member 32. Although not shown, the base member 32 of the exemplary embodiment also includes an additional pair of apertures aligned with the base member apertures 42 and extending through an opposite side of the base member 32. As best shown in FIGS. 5-7, the latch assembly 24 further includes a pair of bolts 44 extending through the base member apertures 42. When installed on the pontoon boat 20, the bolts 44 also extend through the second wall segment 30 to secure the base member 32 to the second wall segment 30. However, it should be appreciated that a range of other attachment means, such as adhesives, snap-on fasteners, welding, etc. could be used to secure the base member 32 to the second wall segment 30 of the pontoon boat 20 rather than the bolts 44 of the exemplary embodiment.

Figure 9:
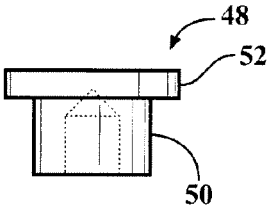
FIG. 9 is a side view of an exemplary stud.
Figure 10:
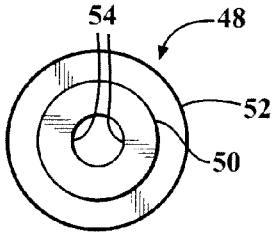
FIG. 10 is a bottom view of the exemplary stud.

As best shown in FIGS. 3-6, the sliding member 34 of the exemplary embodiment has a generally oval shape and presents an elongated aperture 46 extending through a portion of the length of the sliding member 34. The elongated aperture 46 is generally oval shaped and presents flat sides with round ends. The bolts 44 discussed above extend through the elongated aperture 46, thereby coupling the sliding member 34 with the base member 32 and the second wall segment 30 of the pontoon boat 20. A stud 48 threadedly engages the end of each of the bolts 44 for securing the second wall segment 30, the base member 32 and sliding member 34 together. As shown in FIG. 9, each of the studs 48 includes a first portion 50 and a larger second portion 52. Specifically, the first portion 50 has a diameter that is slightly less than the width of the elongated aperture 46, and the second portion 52 has a diameter that is greater than the width of the elongated aperture 46. As shown in FIG. 10, the bottom of the first portion 50 defines a stud bore 54 having inner threads for threadedly engaging the bolts 44. Once assembled on the latch assembly 24, the first portions 50 of the studs 48 are recessed into the elongated aperture 46 of the sliding member 34 and guide the movement of the sliding member 34 between the latched and unlatched positions. The diameter of the first portion 50 should be carefully chosen to fit within the elongated aperture 46 and allow sliding while not being too small, which might allow undesirable wobbling of the sliding member 34 during the sliding movement.

Figure 11:
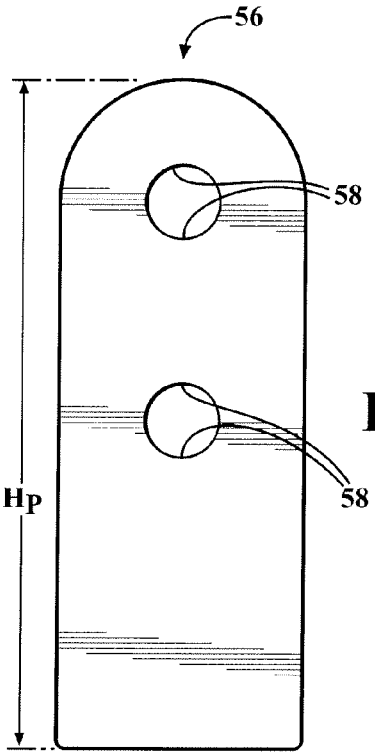
FIG. 11 is a front view of an exemplary stationary glide plate.

The latch assembly 24 further includes a stationary glide plate 56 of a low-friction material different than the material of the base and sliding members 32, 34 disposed between the base and sliding members 32, 34 for providing a low-friction contact surface between the base and sliding members 32, 34. The exemplary stationary glide plate 56 is generally shown in FIG. 11. The stationary glide plate 56 presents a pair of plate apertures 58 sized and spaced similarly to the base member apertures 42 of the base member 32. The bolts 44 described above extend through the plate apertures 58 for interconnecting the stationary glide plate 56 with the base member 32. The stationary glide plate 56 has a second height $H_P$, which is less than the first height $H_S$ of the base member 32. Thus, when the sliding member 34 is in the latched position shown in FIG. 6, the latch assembly 24 defines an open space 70 between the side surface 40 of the base member 32 and the sliding member 34. As shown in FIG. 4, the strike arm 36 of the gate 22 is trapped in this open space 70 when the gate 22 is latched to the second wall segment 30.

Figure 12:
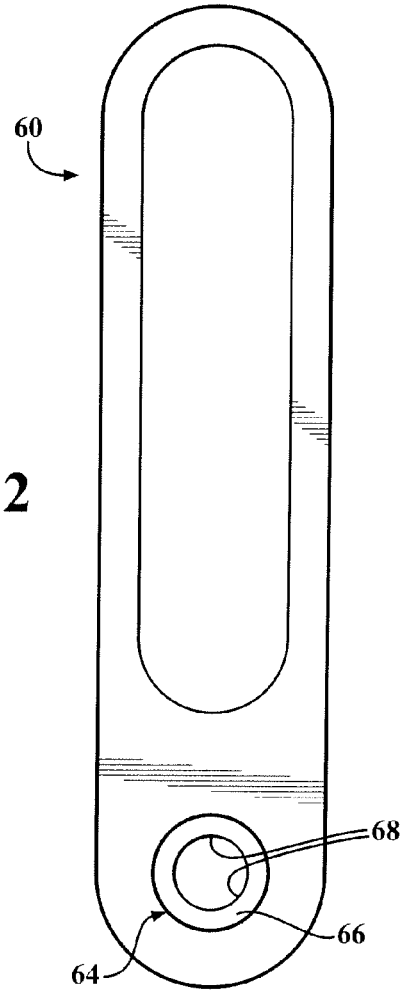
FIG. 12 is a front view of an exemplary sliding glide plate.
Figure 13:
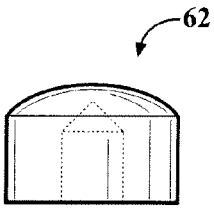
FIG. 13 is a side view of an exemplary knob.
Figure 14:
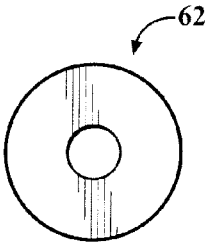
FIG. 14 is a bottom view of the exemplary knob.

To further reduce the friction required to slide the sliding member 34 relative to the base member 32, the latch assembly 24 also includes a sliding glide plate 60 of a low-friction material, which is generally shown in FIG. 12. The sliding glide plate 60 is secured to the sliding member 34 for sliding with the sliding member 34, and the sliding glide plate 60 is disposed between the sliding member 34 and the stationary glide plate 56. In other words, the low-friction contact surface between the base and sliding members 32, 34 is the contact area between the base and sliding glide plates 56, 60.

In the exemplary embodiment, the stationary and sliding glide plates 56, 60 are both produced of a polyoxymethylene material, such as Delrin®, which is a product of the E.I. Dupont Company. Polyoxymethylene has been found to provide a surface with particularly desirable coefficient of friction, durability, aesthetic and wear-resistant properties. However, it should be appreciated that the stationary and sliding glide plates 56, 60 could be of a range of other low-friction materials. Further, in some embodiments, both a stationary glide plate 56 and a sliding glide plate 60 might not be necessary. In other words, the latch assembly 24 might only include either a stationary glide plate 56 or a sliding glide plate 60. Even further, either a surface of the base member 32 or a surface of the sliding member 34 could be coated with a low-friction material to create the low friction contact surface.

As shown in FIGS. 3 and 4, a knob 62 is disposed on the sliding member 34 opposite of the sliding glide plate 60 to provide a handle for raising and lowering the sliding member 34 between the latched and unlatched positions. The sliding glide plate 60 presents a sliding plate bore 64 including a tapered portion 66 and a cylindrical portion 68. A screw (not shown) having a tapered head extends through the sliding plate bore 64 and the sliding member 34 to threadedly engage the knob 62 for interconnecting the sliding glide plate 60, the sliding member 34 and the knob 62. Because of the complementary tapered surfaces of the screw and the tapered portion 66, the top of the screw is flush or recessed relative to the back surface of the sliding glide plate 60.

Figure 15:
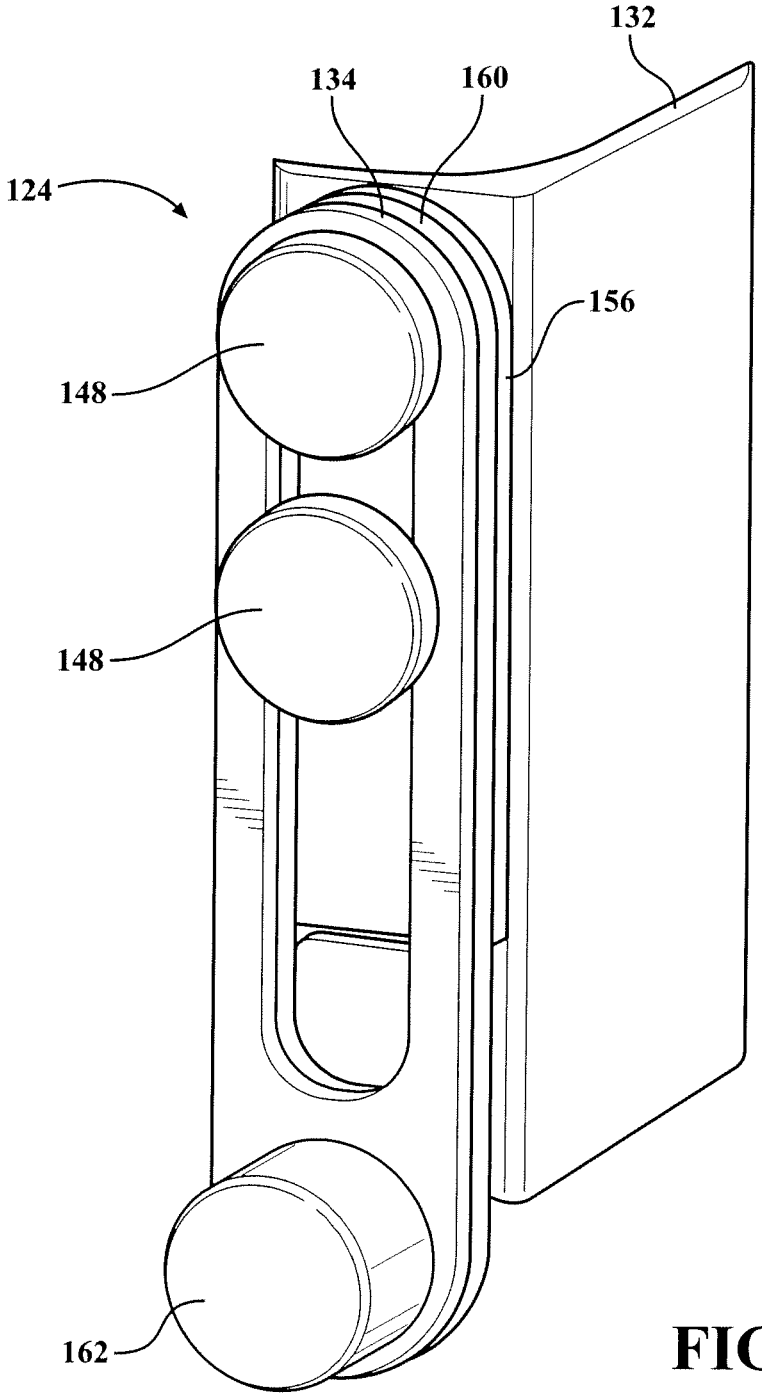
FIG. 15 is a side view of an alternate embodiment of the latch assembly.

A second exemplary embodiment of the latch assembly 124 is generally shown in FIG. 15. Like the first exemplary embodiment, the second exemplary embodiment includes a stationary base member 132, a sliding member 134, a stationary glide plate 156, a sliding glide plate 160, a pair of bolts 144, a pair of studs 148 and a knob 162. However, the second exemplary embodiment is distinguished by the shape of the base member 132. The second exemplary latch mechanism might be preferred for latching a gate 22 to a side wall of a pontoon 28.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A boat comprising:

a deck;

at least two wall segments extending upwardly from said deck to at least partially define an interior space;

said wall segments being spaced from one another to define a gap;

a gate hingedly connected to an end of one of said wall segments for selectively opening and closing said gap;

a latch assembly for latching said gate to the other of said wall segments to close said gap and for releasing said gate to allow rotation of said gate;

said latch assembly including a stationary base member having a first height and being mounted on an end of one of said gate and said other wall segment;

said latch assembly including a sliding member slidably coupled to said base member and slidable in opposite directions between a latched position for latching said gate and an opposite unlatched position for releasing said gate;

said latch assembly including at least one glide plate disposed between said sliding and base members;

said glide plate being made of a material different than that of the base member and sliding member and providing a contact surface between said base and sliding members for facilitating movement of said sliding member between said latched and unlatched positions; and wherein said glide plate has a second height that is less than said first height of said base member to present an open space between said base and sliding members when said sliding member is in said latched position for trapping a portion of the gate.

2. The boat as set forth in claim 1 wherein each of said wall segments extends upwardly from said deck to respective free top edges thereof.

3. The boat as set forth in claim 1 wherein said base member is mounted to said other wall segment and further including a strike arm mounted on said gate and sized to be received in said open space between said base and sliding members when said sliding member is in said latched position.

4. The boat as set forth in claim 1 wherein said glide plate is a stationary glide plate fixed to said base member.

5. The boat as set forth in claim 4 further including a sliding glide plate fixed to said sliding member and disposed between said sliding member and said stationary glide plate and wherein said contact surface is the contact surface between said base and sliding glide plates.

6. The boat as set forth in claim 1 and further including at least two bolts spaced vertically from one another and extending through said base member and said glide plate and said sliding member and wherein said sliding member defines an elongated aperture receiving said bolt for allowing said sliding member to slide relative to said bolt.

7. The boat as set forth in claim 1 further including at least two pontoons extending in spaced and parallel relationship with one another and secured to said deck.

8. The boat as set forth in claim 1 wherein the direction of sliding movement between said latched and unlatched positions is generally vertical.

9. A boat comprising:

a deck;

first and second wall segments extending upwardly from said deck to at least partially define an interior space of said boat;

said wall segments being spaced from one another to define a gap;

a gate hingedly connected to an end of one of said wall segments for selectively opening and closing said gap;

a latch assembly for latching said gate to one of said wall segments to close said gap and for releasing said gate to allow rotation of said gate;

said latch assembly including a stationary base member secured to an end of said second wall segment;

said latch assembly including a sliding member slidably coupled to said base member and movable in a first direction to a latched position for latching said gate and movable in a second direction opposite said first direction to an unlatched position for releasing said gate; and said base member including a strike surface and wherein said strike surface is exposed for contacting a portion of said gate when said sliding member is in said unlatched position to protect said second wall segment from contact with said gate.

10. The boat as set forth in claim 9 wherein said second wall segment is painted and said strike surface of said base member protects said second wall segments from paint chips and dents.

11. The boat as set forth in claim 9 further including at least one glide plate disposed between said sliding and base members for providing a contact surface between said base and sliding members for facilitating movement of said sliding member between said open and closed positions.

12. The boat as set forth in claim 9 wherein said glide plate is a stationary glide plate fixed to said base member.

13. The boat as set forth in claim 11 wherein said base member has a first height and said stationary glide plate has a second height being less than said first height and wherein said strike surface of said base member is disposed adjacent to said stationary glide plate.

14. The boat as set forth in claim 13 further including at least one bolt extending through said base member and said glide plate and said sliding member and wherein said sliding member defines an elongated aperture receiving said bolt for allowing said sliding member to slide relative to said bolt.

15. The boat as set forth in claim 14 wherein said at least one bolt is further defined as a plurality of bolts spaced in a vertical direction from one another for guiding said movement of said sliding member in the vertical direction.

16. The boat as set forth in claim 15 wherein each of said bolts is threaded and further including a pair of studs each defining an inner bore presenting threads and wherein each stud threadedly engages one of said bolts on the side of said sliding member opposite of said base member.

17. The boat as set forth in claim 16 wherein each of said studs presents a first portion having a diameter less than the width of said elongated aperture and a second portion having a diameter greater than the width of said elongated aperture.

18. The boat as set forth in claim 17 wherein said elongated aperture is further defined as having a cross-section presenting flat sides and rounded ends and wherein said open position is further defined as having said first portion of the lower of said vertically spaced studs abutting one of said rounded ends of said elongated aperture and wherein said closed position is further defined as having said first portion of the upper of said vertically spaced studs abutting one of said rounded ends.

19. A method of latching a gate to a wall segment in a boat, comprising the steps of:

providing a boat including a plurality of wall segments spaced from one another to present a gap;

providing a gate hingedly coupled to the first wall segments for selectively opening and closing the gap;

providing a latch assembly including a stationary base member coupled to the second wall segment and a sliding member slidably coupled to the base member and at least one glide plate for providing a contact surface between the base and sliding members;

providing a strike arm extending outwardly from the gate;

sliding the sliding member in a first direction relative to the base member to an unlatched position;

pivoting the gate to engage the strike arm against the base member; and sliding the sliding member in a second direction opposite of the first direction to a closed position wherein the strike arm of the gate is trapped between the base and sliding members.

* * * * *